United States Patent [19]

Badders

[11] Patent Number: 4,518,493

[45] Date of Patent: May 21, 1985

[54] NOISE ATTENUATING FILTER FOR FLUID FLOW SYSTEMS

[76] Inventor: Edwin T. Badders, 3040 Riverside Dr. Terr., Chino, Calif. 91710

[21] Appl. No.: 569,845

[22] Filed: Jan. 11, 1984

[51] Int. Cl.[3] ..... B01D 35/02

[52] U.S. Cl. ..... 210/137; 137/547; 210/352; 210/431; 210/432; 251/120

[58] Field of Search ..... 137/436, 445, 517, 547; 210/97, 137, 429, 430, 431, 432, 352; 251/120

[56] References Cited

U.S. PATENT DOCUMENTS 3,994,029 11/1976 Badders ..... 137/445 X 4,257,452 3/1981 Hill et al. ..... 137/517 X

*Primary Examiner*—Richard V. Fisher

*Assistant Examiner*—W. Gary Jones

*Attorney, Agent, or Firm*—Lyon & Lyon

[57] ABSTRACT

A noise attenuating filter for use in a fluid flow systems which includes a cylindrical body defining a plurality of arcuate open-ended passageways extending longitudinally therethrough, a corresponding plurality of small radial slots in one end thereof communicating with the passageways and a closing member biased outwardly from the slotted end of the cylindrical body so that during use, fluid flows about the closing member and into and through the arcuate passageways until such time as the fluid pressure on the closing member causes the closing member to cover the upstream end of the annular passageways whereupon the fluid is caused to travel into the passageways through the smaller radial slots thereby reducing the volume of flow through the system and attenuating the noise of the fluid flow while additionally preventing the passage of large particles through the system. When the pressure on the closing member is reduced, the closing member snaps outwardly clearing the filter of any particles accumulating therein.

4 Claims, 4 Drawing Figures

NOISE ATTENUATING FILTER FOR FLUID FLOW SYSTEMS

BACKGROUND OF THE INVENTION

The present invention relates to a noise attenuated filter for use in fluid flow systems and in particular, the system developed for use in toilet flushing mechanisms of the water tank type which is the subject of U.S. Pat. No. 3,994,029.

U.S. Pat. No. 3,994,029, the teachings of which are incorporated herein by reference, is directed to a fluid control system employed in a toilet flushing mechanism of the type tank which is operable with less water than conventional flushing mechanisms and rapidly releases all of the water held within the cistern drain immediately upon actuation to provide a more thorough flushing of the toilet bowl. While the patented mechanism is more quiet than the conventional toilet flushing mechanisms, the high velocity water flow used therein does create a degree of noise particularly in high line pressure installations which, although not overly objectionable, could be reduced. In addition, it would be desirable to provide a filtering mechanism for the removal of particles from the high velocity flow which might tend to clog or otherwise interfere with the operation of the fluid control system. The noise attenuating filter device disclosed herein maintains the volume of water flow necessary for the proper functioning of the aforesaid fluid control system while sufficiently reducing the velocity of the flow to attentuate the noise generated thereby and additionally provides a self-cleaning filtering mechanism for the system.

SUMMARY OF THE INVENTION

Briefly, the present invention relates to a device for attenuating the noise in a fluid flow system while providing a self-cleaning filter therefor. The device is self-actuating upon the fluid pressure within the system reaching a predetermined level to restrict the volume fluid flow therethrough thereby attenuating the noise of the fluid flow within the system while preventing particles from entering the system which otherwise might adversely affect the operation thereof.

It is the principal object of the present invention to provide a noise attentuating filter for use in fluid flow systems.

It is another object of the present invention to provide a device for attentuating the noise in a fluid flow system which is actuated in response to the pressure within the system exceeding a predetermined limit.

It is another object of the present invention to provide a device for attentuating the noise in a low pressure fluid flow system.

It is a further object of the present invention to provide a noise attenuator for a fluid flow system which also filters the fluid through the system and is self-cleaning.

It is yet another object of the present invention to provide a device for attentuating the noise in a fluid flow system which also functions as a water savings device.

It is yet another object of the present invention to provide a noise attentuating filter for a fluid flow system which is of simple construction and economical to manufacture.

These and other objects of the present invention will become apparent from the following detailed description taken in conjunction with the accompanying drawings.

IN THE DRAWINGS

Figure 3:
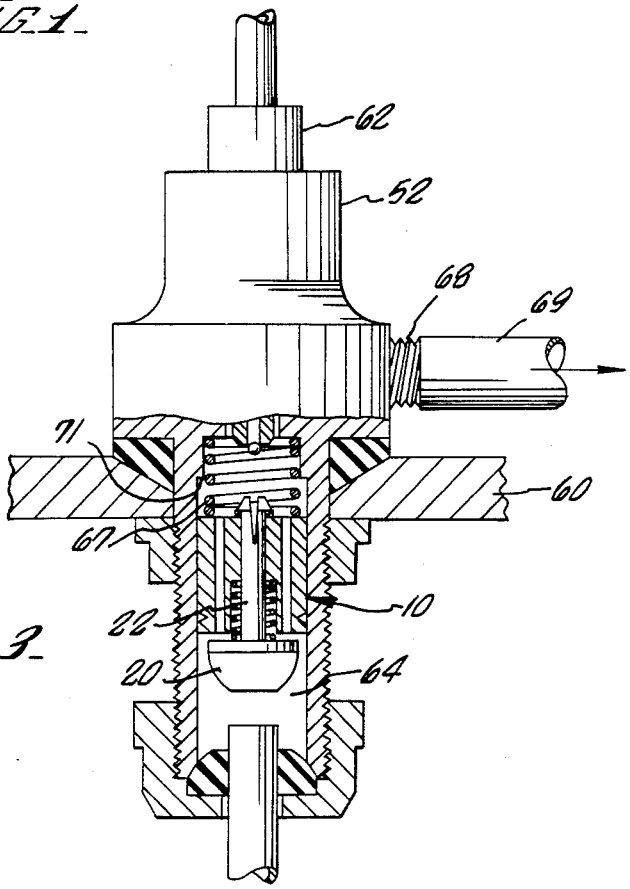

FIG. 3 is a partial sectional view of the noise attenuating filter in place in the diverter valve mechanism of the fluid flow system described and illustrated in U.S. Pat. No. 3,994,029.

Figure 4:
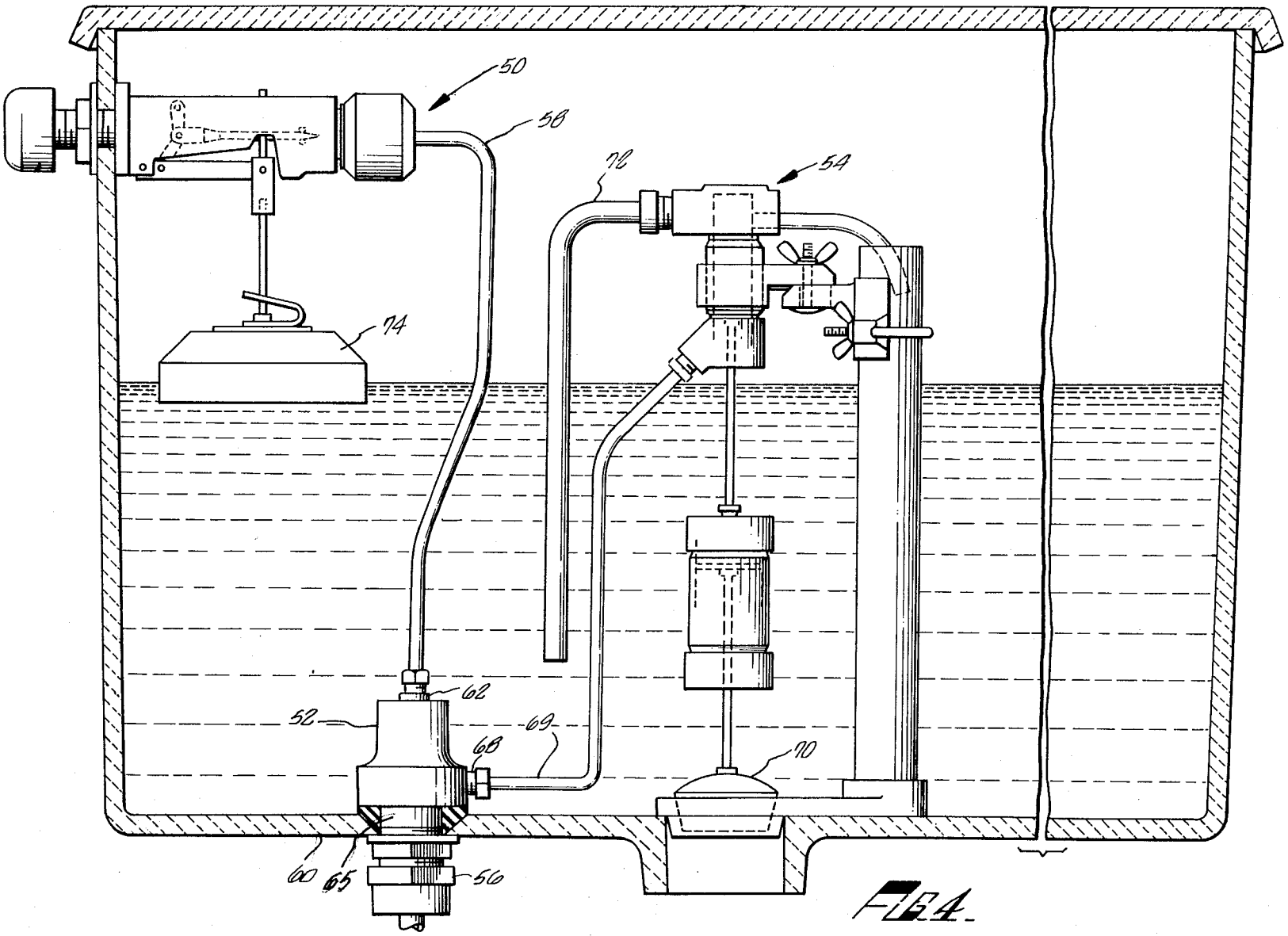

FIG. 4 is a sectional view of a tank type toilet embodying the fluid flow control mechanism set forth and described in U.S. Pat. No. 3,994,029.

DESCRIPTION OF THE PREFERRED EMBODIMENT

Figure 1:
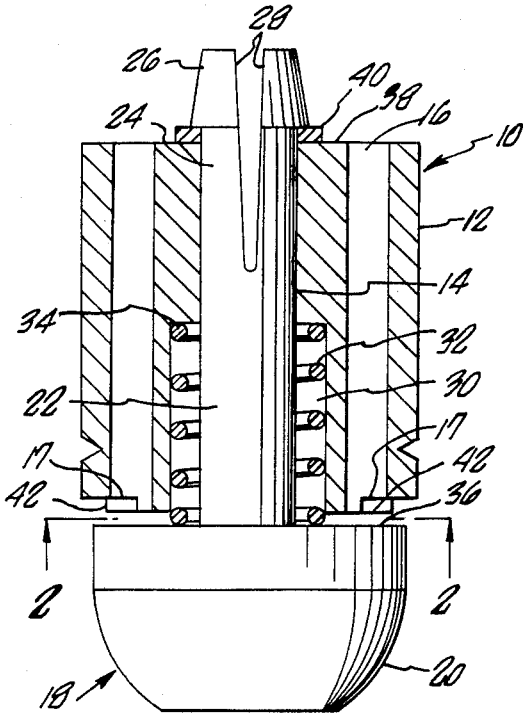
FIG. 1 is a sectional view of the noise attenuating filter of the present invention.
Figure 2:
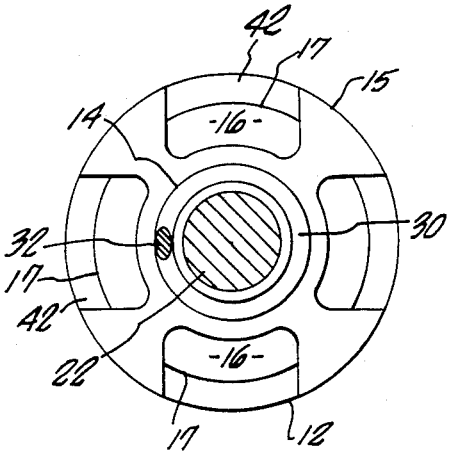
FIG. 2 is a sectional view of the noise attenuating filter taken through line 2—2 in FIG. 1.

Referring now in detail to the drawings, FIGS. 1 and 2 illustrate the preferred embodiment of the noise attenuating filter 10. As seen therein, the noise attenuating filter 10 is comprised of a cylindrical body portion 12 defining a centrally disposed chamber 14 and a plurality of arcuate fluid passageways 16 extending therethrough, and a closing member 18. The passageways are separate by a webbing 15 which also separates the passageways from the central chamber 14. The closing member 18 is comprised of an enlarged head portion 20 and stem portion 22 integrally formed therewith. The stem portion 22 is bifurcated along the extended end 24 thereof and defines a split locking head 26 having a tapered inner conical sidewalls 28. To secure the closing member to the body portion of the noise attenuating filter 10, it is only necessary to insert the stem portion 22 thereof through chamber 14. The split locking head will be pressed together and snap back apart as soon as the head clears the chamber 14 at the downstream end thereof.

The central chamber 14 in the cylindrical body portion 12 has an enlarged upstream portion 30 adapted to receive a coil spring 32. Coil spring 32 is held between an annular wall 34 at the downstream end of the enlarged portion 30 of chamber 14 and the underside 36 of the head portion 20 of closing member 18. The downstream end 38 of the noise attenuating filter 10 is also provided with an annular stop 40 disposed about the downstream end of the central chamber 14 against which the underside of the split locking head 26 bears under the force exerted by the spring 32 on the head portion 20 of closing member 18.

As seen in FIG. 1, the upstream end of the cylindrical body portion 12 has a plurality of radial slots 42 in the sidewall thereof communicating with the inlet openings 17 at the upstream ends of the arcuate passageways 16. The transverse dimensions of slots 42 are substantially less than the transverse dimensions of the inlet openings 17.

In use, the noise attenuating filter 10 is disposed in a conduit or chamber 65 (see FIG. 4) within the fluid system such that the fluid flow must pass about the head portion 20 of closing member 18, through slots 42 and through the attenuating filter 10 via arcuate passageways 16. To provide for operation in fluid flow systems where the pressure may be as low as 1 psi, the cylindrical body 12 can be biased within the conduit or chamber 64 by a spring member 67 so that the body 12 can move reciprocally therein and thereby provide displacement for a larger volume of fluid flow through the system upon initial actuation of a control valve. For operation in all but very low fluid pressure systems, the attenuating filter 10 can be fixed within the chamber or conduit and the spring 67 would not be employed.

FIG. 4 illustrates the fluid control system disclosed in U.S. Pat. No. 3,994,029 which employs a directional flow valve mechanism or diverter valve 52 in which the noise attentuating filter 10 is mounted. While the operation of the diverter valve mechanism and fluid control system is fully described in the aforesaid patent, the teachings of which are incorporated herein, only a brief explanation thereof is necessary to understand the operation and function of the noise attenuating filter 10 of the present invention. Basically, the system comprises a control valve 50, a direction flow valve mechanism 52 and a tank bowl drain lifting assembly 54. The details of the construction and operation of this system are discussed in the aforesaid patent, the teachings of which are fully incorporated herein. Briefly the control valve 50 communicates with a standard water inlet 56 through conduit 58 and the directional flow valve mechanism 52 which is mounted in the floor of the toilet tank 60. The actuation of control valve 50 causes the valve to open and water under line pressure then flows past the open valve and spills into the tank 60. The opening of the control valve also rapidly relieves the line pressure at the upper outlet end 62 of the directional flow valve mechanism 52 and pressure on the upper surface of a piston (not shown) within valve mechanism 52 causing the piston to move upwardly within an upper chamber therein, closing the outlet end 62 and communicating the water inlet 56 with outlet 68 and conduit 69. The water then flows rapidly under line pressure from the water inlet 56 about the head portion 20 of the closing member 18 of the noise attenuating filter 10 into the inlet openings 17 and through the arcuate fluid passages 16 to the outlet 68 located in the side of the diverter mechanism 52 to activate the tank bowl drain lifting assembly 54 which raises the sealing tank ball 70 and empties the toilet tank.

When the line pressure in the fluid flow system is below 30 psi, there is little if any, objectionable noise generated by the aforesaid fluid flow system. However, line pressures often exceed 30 psi. When this occurs the noise generated by the flowing water becomes objectionable. Accordingly, spring member 32 is sized such that a line pressure of 30 psi generates sufficient force on the head portion of the closing member to compress spring 32 and cover the inlet openings 17 to the arcuate passageways 16. At this time the attenuating filter 10 also moves downstream of the fluid flow, comprising spring 67 until the attenuator abuts shoulder 71 formed adjacent the downstream end of chamber 64. Upon covering of inlets 17, the fluid is caused to flow into passageways 16 radially through slots 42, which provide a smaller inlet to the arcuate passageways thereby reducing the volume of flow through the system. Such a reduction in fluid flow attenuates the noise created by the slower flowing water without adversely affecting the operation of the water control system while additionally acting as a water savings device.

While fluid is passing through the slots 42, the reduced size of the openings also acts as a filter to prevent the passage of particles therethrough which otherwise might adversely affect the fluid flow system in which the noise attenuating filter is employed.

In the aforesaid patented system, when the water is drained from the toilet tank upon the raising of the tank ball, the tank is then refilled through the tank fill line 72. As the water level rises, the float 74 carried by the control valve 50 causes the control valve to close which builds up pressure in the upper portion of the diverter flow valve mechanism 52 causing the piston (not shown) therein to move downwardly and side seal outlet 68. At that time the dynamic pressure against the head portion 20 of the closing member 18 in the noise attenuating filter 10 is relieved and the static pressure within the system is equalized. Spring 67 then snaps the attenuating filter 10 back toward upstream end of diverter body within chamber 64 and the spring member 32 snaps the head portion 20 of the closing member forwardly with respect to the body portion 12 of the noise attenuating filter, knocking out any particles or other debris trapped by the noise attenuating filter 10. When the attenuating filter 10 is fixed within the chamber as is contemplated in all but very low pressure systems, the operation of the attenuating filter is identical except that the filter itself does not move.

By way of example, the cylindrical body portion 12 of the noise attenuating filter 10 has an external diameter of about 11/16 inch and the enlarged head portion 20 of the closing member has an external diameter of about 9/16 inch. The spacing between the underside 36 of the head portion 20 and the upstream end of the body portion 12 which defines the distance the closing member 18 can travel with respect to the body member 12 is about 0.040–0.060 in. The transverse dimensions of the inlets and radial passageways through the noise attenuating filter are about 0.01 to 0.5 in. The radial slots 42 have a width of about 0.001–0.006 in. which in turn defines the size of the reduced inlet openings for the fluid passages 16 when spring member 32 is compressed and the closing member 18 is in the closed position. The coil spring 34 has a spring load of about 3 to 4 lbs. So sized, the noise attenuating filter 10 is responsive to pressures exceeding 30 psi. For low pressure installations, coil spring 67 has a spring rate or load of about 2–3 lbs. These various parameters could, of course, be changed to effectuate operation of the device at a different pressure level and to alter both the noise reduction and filtering characteristics of the device. For example, reducing the size of the slots 42 would further reduce the fluid flow therethrough thereby further attenuating the noise and additionally provide finer filter for removal of smaller particles. Further, if it were desired to handle greater fluid flow the diameter of the noise attenuating filter 10 as well as the major transverse axes of passageways 16 and radial inlet slots 17 would be slightly increased. The narrow width of slots 42, however, would retain the noise attenuation benefit of the filter.

Various changes in modifications may be made in carrying out the present invention without departing from the sphere and scope thereof. Insofar as these changes and modifications are within the purview of the appended claims they are to be considered as part of the present invention.

I claim:

1. A noise attenuating filter for use in a fluid flow system comprising: a cylindrical body member having a fluid inlet end and a fluid outlet end and defining a central aperture extending axially therethrough, means defining an annular chamber disposed about said aperture, means defining a plurality of fluid passageways extending axially through said body member externally of said chamber and terminating in a corresponding plurality of axially disposed fluid inlets in the inlet end of said body member and defining a plurality of axially disposed fluid outlets in the outlet end of said body member and defining a corresponding plurality of slots in said fluid inlet end of said body member extending radially from said fluid inlets, the cross-sectional area of each of said slots being less than the cross-sectional area of each of said fluid inlets and defining means for filtering said fluid to prevent objects larger than said slots from passing therethrough, a closing member having a stem portion and a head portion, said stem portion extending through the central aperture in said body member and said head portion extending over the fluid inlet end of said body member and being adapted to seal said fluid inlets; means carried by said body member for maintaining said stem portion of said closing member within said aperture in said body member; and means disposed within said annular chamber in said body member for biasing said head portion of said closing member from said fluid inlet end of said body member, said inlets, passageways, outlets and said closing member defining means for reducing noise by allowing fluid in said system to flow about said head portion into said fluid inlets, through said fluid passageways and out said fluid outlets and upon said head portion of said closing member being pressed into sealing engagement with said fluid inlet end of said body member, the fluid flows into said fluid passageways through said radial slots.

2. The combination of claim 1 wherein said stem portion is slideably mounted within said cylindrical body member.

3. The combination of claim 2 wherein said biasing means comprises a spring member disposed within said chamber and bearing against said cylindrical body member and said head portion of said closing member.

4. The combination of claim 3 wherein said biasing means comprises a spring member having a spring load of about 3 to 4 lbs.

* * * * *